US007508408B2

(12) United States Patent
Kanzaki et al.

(10) Patent No.: US 7,508,408 B2
(45) Date of Patent: Mar. 24, 2009

(54) IMAGE FORMING APPARATUS CAPABLE OF EFFECTIVELY INITIALIZING A LASER DRIVE CIRCUIT

(75) Inventors: Yoshio Kanzaki, Ohta-ku (JP); Hidetoshi Kanai, Yokohama (JP); Katsuhiko Maeda, Kawasaki (JP); Shinya Tanaka, Setagaya-ku (JP)

(73) Assignee: Ricoh Company Ltd., Tokyo (JP)

( * ) Notice: Subject to any disclaimer, the term of this patent is extended or adjusted under 35 U.S.C. 154(b) by 218 days.

(21) Appl. No.: 11/552,675

(22) Filed: Oct. 25, 2006

(65) Prior Publication Data

US 2007/0097201 A1 May 3, 2007

(30) Foreign Application Priority Data

Oct. 27, 2005 (JP) ..... 2005-313128
Sep. 5, 2006 (JP) ..... 2006-240608

(51) Int. Cl.
*B41J 2/435* (2006.01)
*B41J 2/47* (2006.01)

(52) U.S. Cl. ..... 347/235; 347/250

(58) Field of Classification Search ..... 347/234–237, 347/246–250, 261, 243, 259; 372/38.02, 372/38.08; 250/234
See application file for complete search history.

(56) References Cited

U.S. PATENT DOCUMENTS 5,163,063 A * 11/1992 Yoshikawa et al. ..... 372/38.02
5,742,324 A * 4/1998 Suzuki ..... 347/247
6,031,562 A * 2/2000 Yamanaka ..... 347/261
6,833,856 B2 12/2004 Maeda
6,891,868 B2 * 5/2005 Verboom et al. ..... 372/38.08
7,045,771 B2 * 5/2006 Ishikawa et al. ..... 250/234
2005/0206719 A1 * 9/2005 Komiya et al. ..... 347/248
2006/0176363 A1 8/2006 Maeda

FOREIGN PATENT DOCUMENTS

JP 01259585 A * 10/1989
JP 2004-153118 5/2004
JP 2005-129842 5/2005

* cited by examiner

*Primary Examiner*—Hai C Pham
(74) *Attorney, Agent, or Firm*—Oblon, Spivak, McClelland, Maier & Neustadt, P.C.

(57) ABSTRACT

An image forming apparatus capable of properly performing an initialization of a control circuit including a laser diode driver circuit, includes a light source, a photoreceptor, a deflector, and a controller. The photoreceptor is built in the light source to detect incident light. The deflector deflects the laser light into a scanning laser beam. The controller controls the light source to light on and off, and obtains a laser light emission amount of the light source relative to a current flowing through the light source based on a detection of incident light by the photoreceptor. The controller determines the laser light emission amount of the light source during a time period when a path of the laser light from the light source is headed to a reflection surface of the deflector at an incident angle of approximately ninety degrees.

4 Claims, 7 Drawing Sheets

IMAGE FORMING APPARATUS CAPABLE OF EFFECTIVELY INITIALIZING A LASER DRIVE CIRCUIT

BACKGROUND OF THE INVENTION

1. Field of the Invention

The present invention relates to an image forming apparatus, and more particularly to an image forming apparatus capable of effectively initializing a laser drive circuit.

2. Discussion of the Related Art

A background electrophotography image forming apparatus such as a printer, a multi-function machine, and so forth generally employs a combination of a laser scanning and a photoconductive drum to initially form an electrostatic latent image. An optical scanning system performing the laser scanning is typically integrated in a housing, and an image forming mechanism is provided with various components arranged around the photoconductive drum. The optical scanning system drives a laser diode (LD) with a modulated signal so that the laser diode emits a modulated laser light beam. The laser beam is deflected by a polygon mirror to scan a photoconductive surface of the photoconductive drum. As a consequence of laser scanning, an electrostatic latent image is formed on the photoconductive drum.

The optical scanning system needs to perform an initial detection on the above-mentioned laser diode so as to maintain an output laser of the laser diode at a constant level. Generally, a photodiode is used for the initial detection of a laser emission amount. For example, Japanese unexamined laid-open patent application publication No. 2004-153118 describes a semiconductor laser drive apparatus which allows a laser diode to light on with a digital data signal from an initialization circuit. For another example, Japanese unexamined laid-open patent application publication NO. 2005-129842 describes a semiconductor laser drive apparatus which can shorten a time period for detecting a differential quantum efficiency in accordance with properties of a laser diode.

The optical scanning system, however, has an inherent drawback. When a laser light beam impinges on a reflection surface of the polygon mirror at an incident angle of approximately 90 degrees, a reflected laser light beam straightly return to the photodiode included in the laser diode. If this happens, the laser diode cannot properly radiate the laser light.

SUMMARY OF THE INVENTION

In view of the foregoing, it is an object of the present invention to provide an image forming apparatus which is capable of effectively performing an initialization of a control circuit including a laser diode driver circuit. In one example, an image forming apparatus includes a light source, a photoreceptor, a deflector, and a controller. The light source emits laser light. The photoreceptor is built in the light source to detect incident light. The deflector is configured to deflect the laser light into a scanning laser beam. The controller is configured to control the light source to light on and off, and to obtain a laser light emission amount of the light source relative to a current flowing through the light source based on a detection of incident light by the photoreceptor. The controller is further configured to determine the laser light emission amount of the light source during a time period when a path of the laser light from the light source is headed to a reflection surface of the deflector at an incident angle of approximately ninety degrees.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
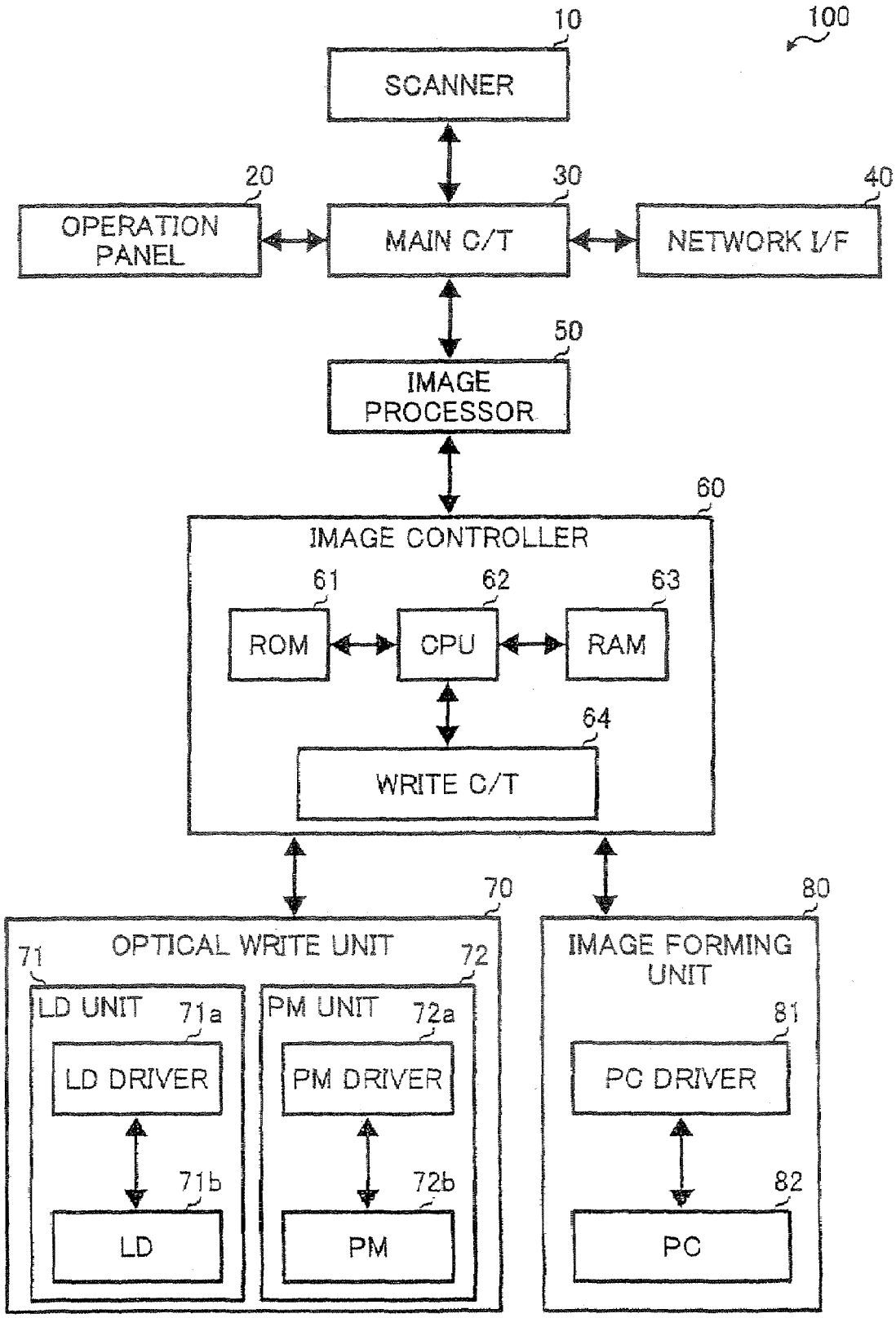
FIG. 1 is a block diagram of an image forming apparatus according an exemplary embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, particularly to FIG. 1, an image forming apparatus 100 according to an exemplary embodiment of the present invention is explained. As illustrated in FIG. 1, the image forming apparatus 100 includes an image scanner 10, an operation panel 20, a main controller (C/T) 30, a network interface (I/F) 40, an image processor 50, an image controller 60, an optical write unit 70, and an image forming unit 80. The image scanner 10 reads an original document to capture image data. The operation panel 20 includes various indicators and switches (not shown) for an operator to communicate with the image forming apparatus 100. The controller 30 controls the entire operations of the image forming apparatus 100. The network interface 40 interfaces communications with other apparatuses through an network. The image processor 50 generates an image write signal based on the image data obtained by the image scanner 10.

The image controller 60 controls the operations of an image writing and forming procedure. The image controller 60 includes a ROM (read only memory) 61, a CPU (central processing unit) 62, a RAM (random access memory) 63, and a write controller (C/T) 64. The ROM 61 stores various programs including specific programs for the image writing and forming procedure. The CPU 62 performs the programs stored in the ROM 61. The RAM 63 stores data at a temporary base. The image write controller 64 includes an application-specific integrated circuit (ASIC) for controlling an image writing operation with a laser light beam.

The optical write unit 70 generates a laser light beam based on the image write signal generated by the image processor 50 and uses it to write an image. The optical write unit 70 includes an laser diode (LD) unit 71 and a polygon motor (PM) unit 72. The LD unit 71 includes a driver 71*a* and a laser diode (LD) 71*b*. The PM unit 72 includes a driver 72*a* and a polygon motor (PM) 72*b*. The driver 71*a* of the LD unit 71 is energized with an input signal from the write controller 64 of the image controller 60 so as to drive the LD 71*b*. The LD 71*b* emits a laser light beam when it is so driven. The driver 72*a* of the PM unit 72 is energized with an input signal from the write controller 64 of the image controller 60 so as to drive the PM 72*b*. The PM 72*b* carries a polygonal mirror 72*c* and is driven to cause the polygonal mirror 72*c* to rotate so as to deflect the laser light beam impinging thereon to be made as a scanning laser light beam.

The image forming unit 80 includes a photoconductor driver 81 and a photoconductor (PC) 82. The photoconductor driver 81 is energized to rotate the photoconductor 82. The photoconductor 82 has an evenly charged surface on which an electrostatic latent image is formed with a laser light beam emitted from the LD unit 71 of the optical write unit 70.

The image forming apparatus 100 having the above-described structure reads an original document through the image scanner 10 and processes the image data of the original document with the image processor 50 and the image controller 60 under control of the main C/T 30. The image forming apparatus 100 generates an image write signal with the image controller 60 and drives the LD 71*b* to irradiate a laser light beam to write an electrostatic latent image on the photoconductor 82 in accordance with the image data of the original document. The electrostatic latent image formed on the photoconductor 82 is developed with toner by a development mechanism (not shown) according to the electrophotographic method. The image of the original document is reproduced with toner in this way, and the reproduced toner image is transferred onto a recording sheet by a transfer mechanism (not shown).

Figure 2:
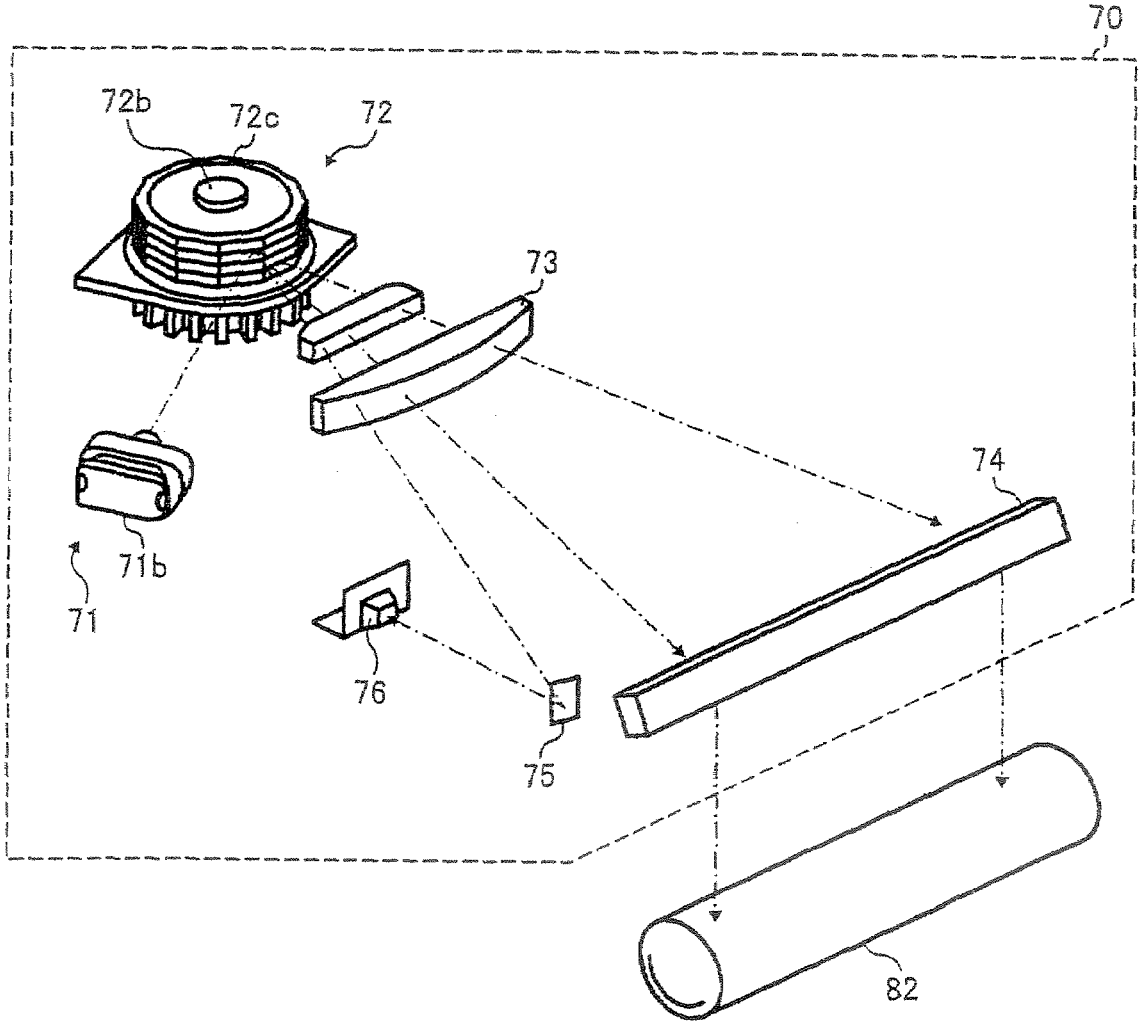
FIG. 2 is an illustration of an optical write unit included in the image forming apparatus of FIG. 1.

Referring to FIG. 2, an exemplary structure of the optical write unit 70 is explained. The optical write unit 70 of FIG. 2 is configured to emit a laser light beam from the LD unit 71 when the laser light beam impinges on a reflection surface of a rotating polygon mirror 72*c* (explained below) of the PM unit 72 at an angle other than an approximately right angle of incidence. That is, the LD unit 71 is not driven to emit the laser light beam which would otherwise impinge on the reflection surface of the rotating polygon mirror 72*c* at an approximately right angle of incidence. During this LD skip period, the optical write unit 70 does not detect a light amount emission accordingly.

As illustrated in FIG. 2, the optical write unit 70 includes the LD unit 71 and the PM unit 72, as described above. The optical write unit 70 further includes an fθ lens 73, a reflection mirror 74, a synchronous mirror 75, and a photoreceptor 76. The fθ lens 73 is configured to converge the scanning laser light beam to form an image. The reflection mirror 74 guides the scanning laser light beam to a surface of the photoconductor 82. The synchronous detection mirror 75 guides the scanning laser beam to the photoreceptor 76. The photoreceptor 76 detects the scanning laser light beam as a synchronous detection beam.

In the optical write unit 70, the laser light beam emitted from the LD 71*b* is collimated through a collimate lens (not shown) and impinges on the surfaces of the polygon mirror 72*c*. The scanning laser light beam generated by the polygon mirror 72*c* passes through an optical system including the fθ lens 73 and the reflection mirror 74 and forms an electrostatic latent image on the photoconductor 82. The scanning laser light beam is modulated to light on and off in accordance with the image data of the original document obtained with the image scanner 10. The scanning laser light beam repeatedly runs on the surface of the photoconductor 82 in a main scanning direction. Since the photoconductor 82 is simultaneously driven to rotate in a sub-scanning direction, an electrostatic latent image is drawn by the scanning laser light beam on the surface of the photoconductor 82. Each time the scanning laser light beam runs, the photoreceptor 76 receives the scanning laser light beam via the synchronous mirror 75 and generates a synchronous detection signal.

In the image forming apparatus 100 having such an optical write unit 70, the write controller 64 determines timings of various signal needed for a control of the LD 71*b* based on the synchronous detection signal generated by the photoreceptor 76 upon a detection of the scanning laser light beam. The electrostatic latent image formed on the photoconductor 82 is developed with a charged toner. The photoconductor transports the developed toner image to an image transfer region to which a recording sheet is conveyed in synchronism with a movement of the toner image. In the image transfer region, the recording sheet is inversely charged relative to the charge of the toner, and is made in close contact with the surface of the photoconductor 82 so that the toner image is attracted to and transferred onto the recording sheet. The recording sheet thus carrying the toner image thereon is then caused to pass through a fixing mechanism (not shown) for fixing toner image with heat and pressure, so that the toner image is fixed onto the recording sheet.

As described above, the optical write unit 70 has the LD skip period, in which the LD unit 71 is not driven to emit the laser light beam which would otherwise impinge on the reflection surface of the rotating polygon mirror 72*c* at an approximately right angle of incidence. During this LD skip period, the optical write unit 70 does not perform a light amount detection (explained below) accordingly. If the laser light beam from the LD 71*b* impinges on the surface of the polygon mirror 72*c* at an approximately right angle of incidence, a reflected laser light beam would return through approximately the same light path and enters a photodiode (PD) installed inside the LD 71*b*, which phenomenon would damage the photodiode of the LD 71*b*.

To avoid an occurrence of this phenomenon, the optical write unit 70 has the LD skip period which can be calculated based on a layout of the optical components and is determined under control of the write controller 64 of the image controller 60 by using counters operated with pixel clock signals. In other words, the optical writ unit 70 performs an operation for energizing the LD 71*b* (i.e., an LD on-and-off drive operation) for an automatic power control (APC) and the synchronous detection operation by avoiding the LD skip period.

Figure 3:
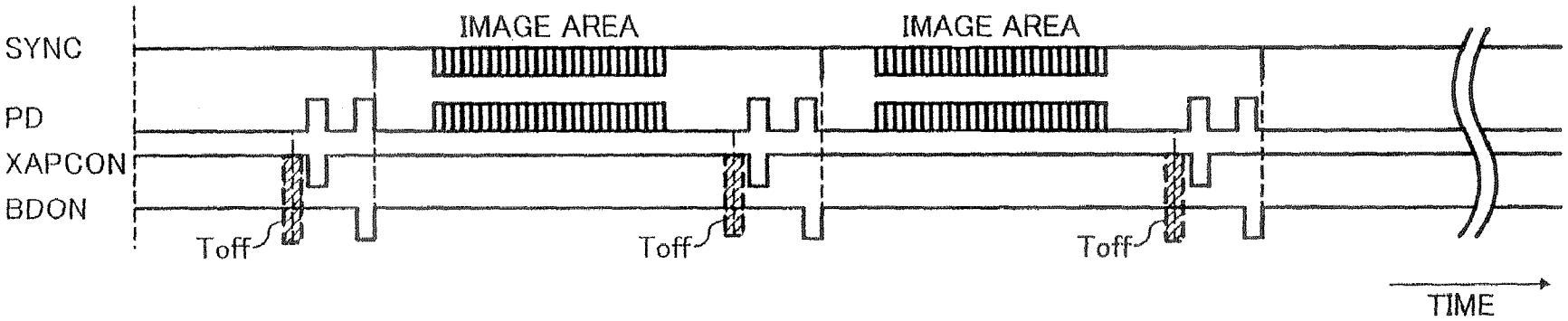
FIG. 3 is a time chart for explaining an exemplary control procedure for driving a laser diode to emit a laser light beam on and off.

FIG. 3 shows a relationship between the LD on-and-off drive operation for APC and the synchronous detection and between the LD on-and-off drive operation for the synchronous detection and the synchronous detection. In FIG. 3, the LD on-and-off drive operation is triggered by a signal XAPCON and is performed before a signal SYNC which is the synchronous detection signal. Also, the LD on-and-off drive operation is triggered by a signal BDON and is performed before the signal SYNC. In FIG. 3, the skip period is shown as a time period Toff which is positioned before the signals XAPCON and BDON. That is, the signals XAPCON and BDON are set to time after the time period Toff. If a revolution number of the polygon motor 72*b* is changed, for example, a time that the laser light beam impinges on the polygon mirror 72*c* at an approximately right angle of incidence may be changed and therefore timing of the signals XAPCON and BDON need to be changed. As such, when operational conditions, for example, a linear speed of the photoconductor 82 and an image resolution are changed, timing of the signals XAPCON and BDON need to be changed. These changes of timings are performed by the CPU 62 with the programs stored in the ROM 61.

Figure 4:
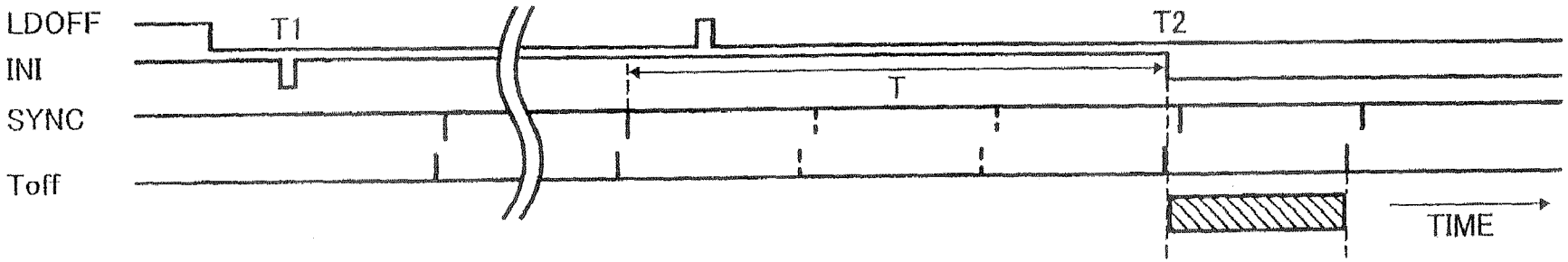
FIG. 4 is a time chart for explaining an initial detection operation of the optical write unit of FIG. 2.

The application-specific integrated circuit (ASIC) of the write controller 64 controls the image writing operation with the laser light beam, as described above. This ASIC performs an initial detection at a time INI not during the time period Toff, as shown in FIG. 4. Specifically, the ASIC detects a threshold current and a light emission current according to properties of each laser diode. This initial detection is started upon a termination of a signal LDOFF after the timing settings with respect to the LD on-and-off control. The LD 71*b* is lit on at a predetermined timing and enters into the photoreceptor 76 which then generates the synchronous detection signal. The image processor 50 receives and processes the synchronous detection signal so that a counter for the main scanning starts operating.

The signal LDOFF is turned on and off at an arbitrary timing by programs. When the signal LDOFF is asserted high, the LD 71*b* is turned off. To turn on the LD 71*b* again, a second time of the initial detection is needed to be performed. The second initial detection is performed within a time period (i.e., a time period with hatching in FIG. 4) after a time T such that the laser light beam reflected by the polygon mirror 72*c* does not return into the photodiode of the LD 71*b*. The time T is a time period counted from the last SYNC before the LD 71*b* is turned on until a next Toff is over.

In the above-described way, the optical write unit 70 avoids a right-angle return, or a right-angle reflection, of the laser light beam to the photodiode of the LD 71*b* by turning off the LD 71*b* during a time period in which the laser light beam would otherwise impinge on the polygon mirror 72*c* at an approximately right angle of incidence. During the time period that the LD 71*b* is turned off, the optical write unit 70 avoids a performance of the laser light emission detection. With such an avoidance, the optical write unit 70 can stably and properly perform the LD emission and the initial detection of the LD emission.

Referring to FIGS. 5A-5D, another control of the optical write unit 70 is explained. In this case, the optical write unit 70 detects the laser light beam impinging on the polygon mirror 72*c* at an approximately right angle of incidence and determines such a detection as an abnormal occurrence. At such an abnormal occurrence, the optical write unit 70 performs to retry the procedure of the LD emission.

Figure 5A:
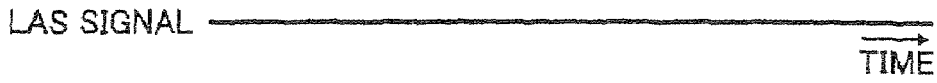
FIGS. 5A-5D are time charts for explaining a relationship between a light amount setting (LAS) signal and a light amount detection (LAD) signal with the exemplary control procedure of FIG. 3.
Figure 5B:
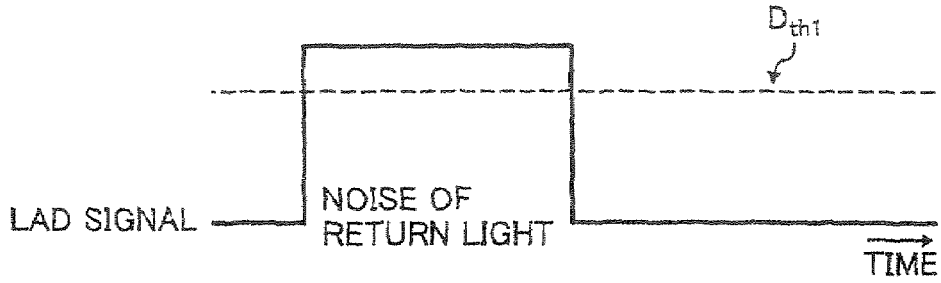
Figure 5C:
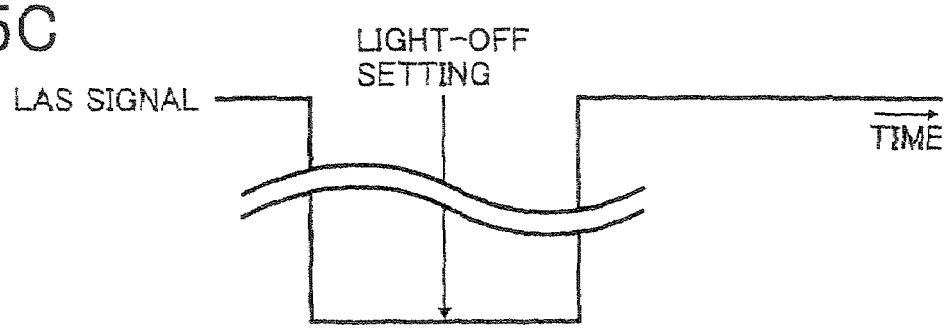

In FIG. 5A, a light amount setting (LAS) signal is held at a constant high level to make the LD 71*b* emit the laser light beam in a continuous manner. With this light amount setting signal, a light amount detection (LAD) signal (i.e., an output voltage of the photodiode of the LD 71*b*) of FIG. 5B shows a noise by a right-angle return light amount when the laser light beam impinges on the polygon mirror 72*c* at an approximately right angle of incidence. With this noise, the LAS signal exceeds a threshold value $D_{th1}$ of a light amount detection. To avoid this, the LAS signal is set at a low level, as shown in FIG. 5C, so as to turn off the LD 71*b* at a timing that the noise of a right-angle return light occurs.

Figure 5D:
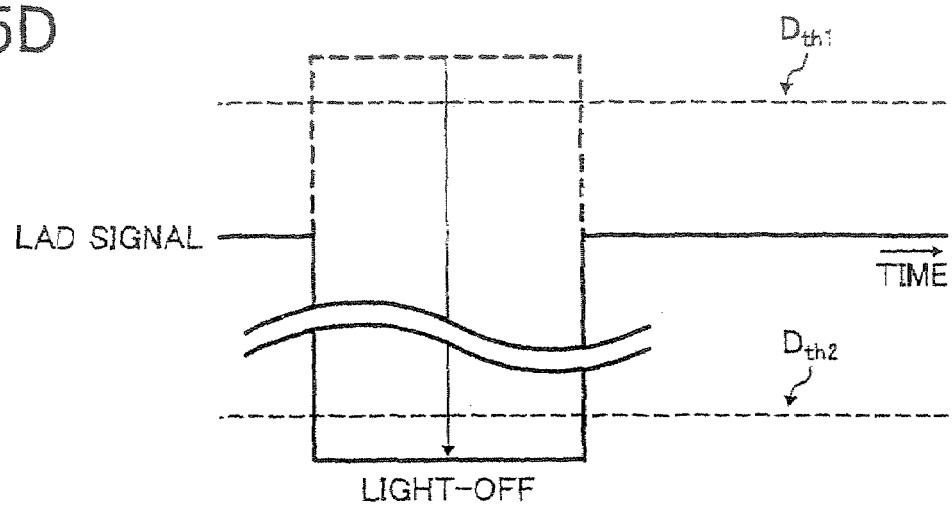

In this way, the detection of the LD emission is constantly performed even during the time the LD 71*b* is turned off. During the time the LD 71*b* is turned off, the LAD signal is lower than a threshold value $D_{th2}$ of a LD-off detection state, as shown in FIG. 5D, based on which an abnormal detection of the light amount is determined. At such a abnormal detection, the optical write unit 70 is programmed to retry the detection of the LD emission until the detection is properly performed. When the time period that the noise of a right-angle return light occurs passes over, the LAS signal is raised to the high level and the LD 71*b* is turned on again so that the LD emission can properly be detected.

Referring to FIGS. 6A-6E, 7A-7D, and 8A and 8B another control of the optical write unit 70 is explained. In this case, the optical write unit 70 sets the laser light emission of the LD 71*b* to a level which cancels the noise by a right-angle return of the laser light beam during the time period that the laser light beam impinges on the polygon mirror 72*c* at an approximately right angle of incidence.

Figures 6A, 6B, 6C, 6D, 6E:
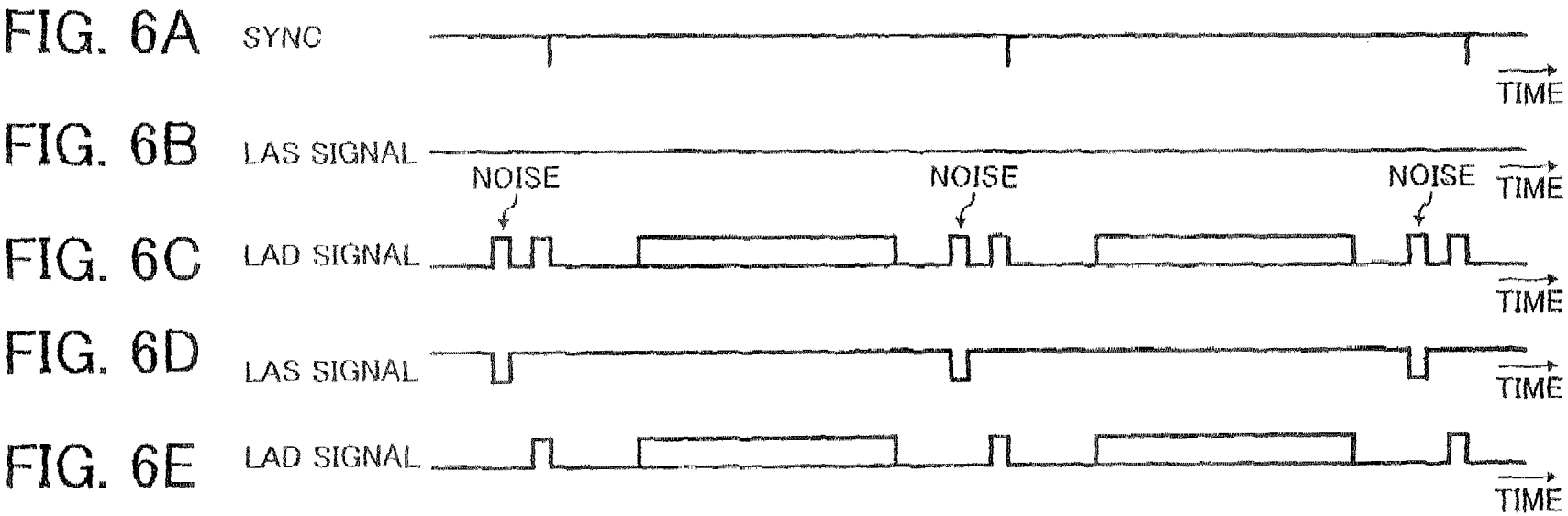
FIGS. 6A-6E are time charts for explaining a relationship between the LAS signal and the LAD signal with another exemplary control procedure for driving a laser diode to emit a laser light beam on and off.

FIGS. 6A-6E explain an exemplary way of reducing an amount of laser light emission from the LD 71*b* when the LD 71*b* receives the right-angle return of the laser light beam. The optical write unit 70 performs the laser light amount detection based on the synchronous detection signal SYNC shown in FIG. 6A. When the light amount setting (LAS) signal is set at a constant level, as shown in FIG. 6B, the LD 71*b* is continuously driven to emit the laser light beam and therefore the light amount detection (LAD) signal output from the photodiode (PD) includes an add-on noise by a right-angle return of the laser light beam, as shown in FIG. 6C. To avoid this add-on noise, the optical write unit 70 adjusts the laser light amount during the time period that the laser light beam impinges on the surfaces of the polygon mirror 72*c* at an approximately right angle of incidence. This adjustment is performed under control of the write controller 64 of the image controller 60 by using counters operated with pixel clock signals and the synchronous detection signal SYNC. That is, as shown in FIG. 6D, the LAS signal is adjusted to a level to reduce the laser light amount of the LD 71*b* during the time period of the noise by the right-angle return of the laser light beam, thereby canceling the noise by the right-angle return of the laser light beam. As a result, the LAD signal substantially eliminates the noise by the right-angle return of the laser light beam, as shown in FIG. 6E. The detection value of the light amount where the add-on noise is eliminated is a basis for adjusting an actual light amount of the LD 71*b*. The detected light amount during the time period that the add-on noise is cancelled may be deviated from a targeted value of the light amount. Therefore, this timing range having a deviation of the light amount is set out of a time frame of the image scanning to avoid an occurrence of a potential problem. In an ordinary layout of an optical system for an image forming apparatus, this timing range is arranged out of the time frame of the image scanning.

Figure 7A:
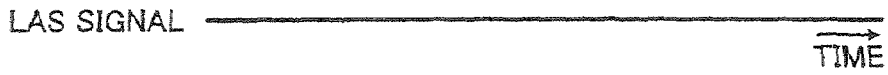
FIGS. 7A-7D are enlarged time charts of FIGS. 6B-6E, respectively.
Figure 7B:
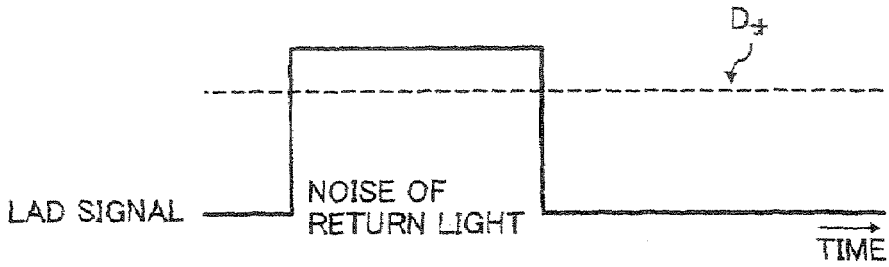
Figure 7C:
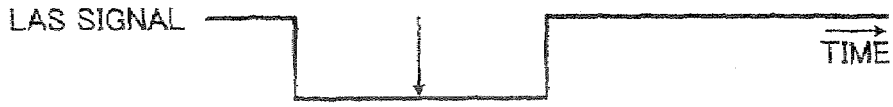
Figure 7D:
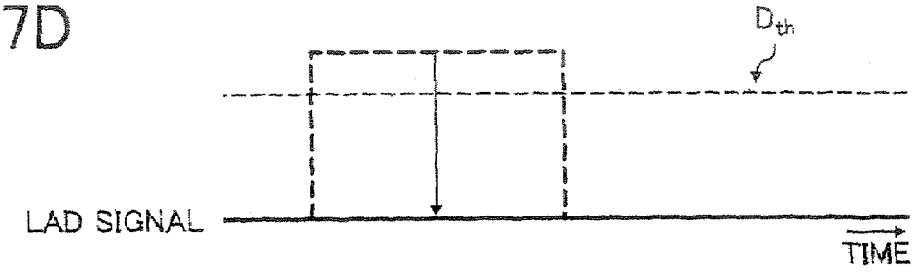

FIGS. 7A-7D demonstrates in more details the above-described exemplary way of reducing an amount of laser light emission from the LD 71*b* when the LD 71*b* receives the right-angle return of the laser light beam. When the light amount setting (LAS) signal is set at a constant level, as shown in FIG. 7A, the LD 71*b* is continuously driven to emit the laser light beam. Under this circumstance, the light amount detection (LAD) signal exceeds a threshold value $D_{th}$ of the laser light detection since the LAD signal includes an add-on noise by a right-angle return of the laser light beam, as shown in FIG. 7B. To avoid this add-on noise, the optical write unit 70 adjusts the laser light amount during the time period that the laser light beam impinges on the surfaces of the polygon mirror 72*c* at an approximately right angle of incidence. That is, as shown in FIG. 7C, the LAS signal is adjusted to a level to reduce the laser light amount of the LD 71*b* during the time period of the noise by the right-angle return of the laser light beam, thereby canceling the noise by the right-angle return of the laser light beam. As a result, the LAD signal substantially eliminates the noise by the right-angle return of the laser light beam, as shown in FIG. 7D. The detection value of the light amount where the add-on noise is eliminated is a basis for adjusting an actual light amount of the LD 71*b*.

The photoreceptor 76 for detecting the light emission amount is configured to abnormally terminate its operation when detecting that the detection value exceeds a threshold value due to a mixture of noise, for example. Such an abnormal termination may be avoided by the reduction of the light emission amount at the time of the right-angle reflection of the laser light beam in the way as described above. Thus, the detection of the light emission amount can be continued without failure by the noise of the right-angle reflection of the laser light beam. The timing range of the reduced laser light emission is out of the time frame of the image scanning. Therefore, if the light emission amount is calculated based on the detection of the light emission amount even during this timing range, any problem may not occur, although the detection result of the reduced laser light emission may not indicate a precisely correct value. As an alternative, the detection result of the light emission amount may be neglected. In this case, an actual value of the light emission amount can be obtained by performing the detection after the timing range of reducing the light emission amount. An actual value of the light emission amount may be sought by calculating the detection results before and after the timing range of reducing the light emission amount.

Figure 8:
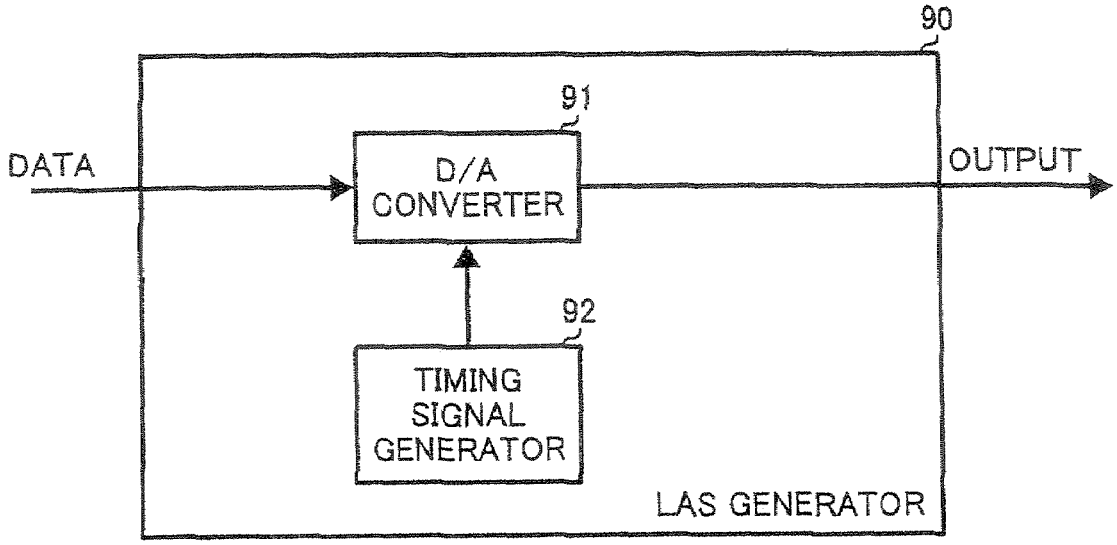
FIG. 8 is a block diagram of a LAS signal generator included in the image forming apparatus of FIG. 1.
Figure 9:
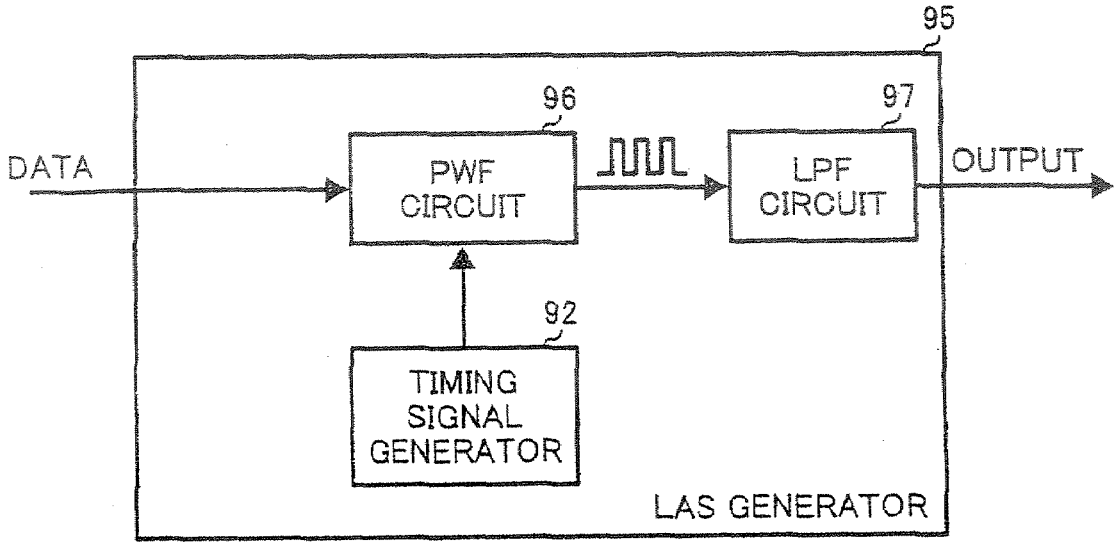
FIG. 9 is a block diagram of another LAS signal generator.

Referring to FIG. 8, a light amount setting (LAS) signal generator 90 is explained. The LAS signal generator 90 is installed in the write controller 64 and includes a D/A (digital-to-analog) converter 91 and a timing signal generator 92. The LAS signal is provided with a voltage variation by the D/A converter 91 at a timing based on a count value of the timing signal generator 92 which is operated with the pixel clocks based on the synchronous detection signal. With this structure, the light amount setting can be controlled in synchronism with the synchronous detection signal SYNC. Thus, a variation control of the light emission amount and a turn-off control of the LD 71*b* may be possible during the time range in which the right-angle reflection of the laser light beam occurs. The LAS signal is generated as an analog voltage signal output from the D/A converter 91. By employing the D/A converter 91, the light amount setting can be achieved in a rather simple configuration. Moreover, the resultant LAS signal can be easily compared with a threshold value of the light amount detection.

In place of the D/A converter 91, a pulse width modulator (PWM) circuit 96 and a low pass filter (LPF) circuit 97 may be employed to generate an analog voltage signal. The PWM circuit 96 generates pulses corresponding to a value of the light amount setting, and the pulses are smoothed by the LPF circuit 97.

Numerous additional modifications and variations are possible in light of the above teachings. It is therefore to be understood that within the scope of the appended claims, the disclosure of this patent specification may be practiced otherwise than as specifically described herein.

This patent specification is based on Japanese patent application, No. JPAP2001-326226 filed on Oct. 24, 2001 in the Japanese Patent Office, the entire contents of which are incorporated by reference herein.

What is claimed is:

1. An image forming apparatus, comprising:

a light source to emit laser light;

a photoreceptor built in the light source to detect incident light;

a deflector configured to deflect the laser light into a scanning laser beam; and a controller configured to control the light source to light on and off, to obtain a laser light emission amount of the light source relative to a current flowing through the light source based on a detection of incident light by the photoreceptor, and to determine the laser light emission amount of the light source during a time period when a path of the laser light from the light source is headed to a reflection surface of the deflector at an incident angle of approximately ninety degrees;

wherein the controller determines the laser light emission amount of the light source to be zero during the time period when the path of the laser light from the light source is headed to the reflection surface of the deflector at an incident angle of approximately ninety degrees.

2. The image forming apparatus of claim 1, wherein the controller stops obtaining the laser light emission amount of the light source relative to the current flowing through the light source, and seeks for the laser light emission amount based on the detection of incident light by the photoreceptor during a time period when the controller allows the light source to light on.

3. The image forming apparatus of claim 1, wherein the controller determines a failure of obtaining the laser light emission amount of the light source when performing an operation of obtaining the laser light emission amount of the light source during a time period when the controller controls the light source to light off, and performs a retry of obtaining the laser light emission amount of the light source at the failure.

4. An optical scanning apparatus, comprising:

a light source to emit laser light;

a photoreceptor built in the light source to detect incident light;

a deflector configured to deflect the laser light into a scanning laser beam; and a controller configured to control the light source to light on and off, to obtain a laser light emission amount of the light source relative to a current flowing through the light source based on a detection of incident light by the photoreceptor, and to determine the laser light emission amount of the light source during a time period when a path of the laser light from the light source is headed to a reflection surface of the deflector at an incident angle of approximately ninety degrees;

wherein the controller determines the laser light emission amount of the light source to be zero during the time period when the path of the laser light from the light source is headed to the reflection surface of the deflector at an incident angle of approximately ninety degrees.

* * * * *